US009719763B2

(12) United States Patent
Hook

(10) Patent No.: US 9,719,763 B2
(45) Date of Patent: Aug. 1, 2017

(54) REUSABLE POLYURETHANE PROJECTILE

(71) Applicant: Shawn C. Hook, Riverside, CA (US)

(72) Inventor: Shawn C. Hook, Riverside, CA (US)

( * ) Notice: Subject to any disclaimer, the term of this patent is extended or adjusted under 35 U.S.C. 154(b) by 6 days.

(21) Appl. No.: 15/180,752

(22) Filed: Jun. 13, 2016

(65) Prior Publication Data

US 2016/0290775 A1 Oct. 6, 2016

Related U.S. Application Data

(63) Continuation-in-part of application No. 14/325,043, filed on Jul. 7, 2014, now Pat. No. 9,366,516.

(60) Provisional application No. 61/860,759, filed on Jul. 31, 2013.

(51) Int. Cl.

| | |
|---|---|
| ***F42B 33/02*** | (2006.01) |
| ***F42B 33/00*** | (2006.01) |
| ***F42B 12/74*** | (2006.01) |
| ***F42B 12/34*** | (2006.01) |
| *F42B 5/02* | (2006.01) |

(52) U.S. Cl.

CPC ..... *F42B 33/001* (2013.01); *F42B 12/34* (2013.01); *F42B 12/745* (2013.01); *F42B 5/02* (2013.01)

(58) Field of Classification Search

CPC ..... F42B 5/02; F42B 12/74; F42B 33/001; F42B 12/34

USPC ..... 86/18, 54; 102/502

See application file for complete search history.

(56) References Cited

U.S. PATENT DOCUMENTS

| | | | | |
|---|---|---|---|---|
| 358,984 | A | 3/1887 | Quackenbush | F24B 12/74 164/326 |
| 2,535,616 | A | 12/1950 | Wadman | F42B 33/14 86/19 |
| 2,983,224 | A | 5/1961 | Prosen | B29C 45/14426 102/522 |
| 3,077,636 | A | 2/1963 | Peters | B29C 45/20 425/197 |
| 3,171,350 | A | 3/1965 | Olney | B29C 43/00 102/467 |
| 3,326,133 | A | 6/1967 | Stadler et al. | |
| 3,646,845 | A | 3/1972 | Semel | C06D 3/00 102/334 |
| 3,769,873 | A | 11/1973 | Abel | F42B 5/188 102/431 |
| 3,787,278 | A | 1/1974 | Ready | B29C 44/0446 273/DIG. 8 |

(Continued)

*Primary Examiner* — Michelle R Clement

(74) *Attorney, Agent, or Firm* — Kirk A. Buhler; Buhler & Associates

(57) ABSTRACT

Improvements in a reusable polyurethane projectile are presented. The reusable polyurethane projectile performs like a bullet or projectile because the projectile is essentially the same size and shape of a bullet and can be fed through a normal bullet clip into the breach of a gun, fired and ejected. The reusable polyurethane projectile conforms to the rifling of the barrel of the firearm to spin the projectile and provide equivalent accuracy to a metallic bullet. Upon impact the projectile will flatten and then rebound to the original shape. Standard re-loading mechanisms can be used to install the projectile back into a prepared cartridge. The reusable projectile is fabricated from a casting process that increases the resistance of the polyurethane from melting when the hot gun gunpowder pushes the reusable projectile out of the barrel of the gun.

17 Claims, 5 Drawing Sheets

(56) References Cited

U.S. PATENT DOCUMENTS

| | | | | |
|---|---|---|---|---|
| 3,815,502 | A | 6/1974 | Mawhinney | F42B 5/02 102/449 |
| 4,342,141 | A | 8/1982 | Graham | F42B 12/74 86/1.1 |
| 4,405,269 | A | 9/1983 | Hertzler | B23B 51/10 408/211 |
| 4,419,796 | A | 12/1983 | Broden | B29C 45/14065 86/52 |
| 5,214,237 | A | 5/1993 | McArthur | |
| 5,239,928 | A | 8/1993 | Ricci | F42B 5/067 102/430 |
| 5,259,319 | A | 11/1993 | Dravechy et al. | |
| 5,415,151 | A | 5/1995 | Fusi | F42B 12/72 124/1 |
| 5,535,495 | A | 7/1996 | Gutowski | B22D 17/00 86/54 |
| 5,967,916 | A | 10/1999 | Robeson | A63F 9/0278 473/600 |
| 6,048,379 | A | 4/2000 | Bray | C08K 3/08 102/517 |
| 6,240,850 | B1 | 6/2001 | Holler | F42B 5/025 102/439 |
| 6,295,933 | B1 | 10/2001 | Dubocage | F42B 12/745 102/439 |
| 6,845,716 | B2 | 1/2005 | Husseini | F42B 5/307 102/466 |
| 7,059,233 | B2 | 6/2006 | Amick | A01K 95/005 102/517 |
| 7,063,021 | B2 | 6/2006 | Keegstra et al. | |
| 7,143,699 | B2 | 12/2006 | Brock | |
| 7,237,490 | B2 | 7/2007 | Keegstra et al. | |
| 7,278,358 | B2 | 10/2007 | Huffman | |
| 7,614,349 | B2 | 11/2009 | Puskas | F42B 12/745 102/502 |
| 7,658,137 | B1 | 2/2010 | Romero | F42B 7/10 102/502 |
| 7,665,402 | B2 | 2/2010 | Harrison | F42B 5/10 102/374 |
| 7,743,708 | B1 | 6/2010 | Lawrence | |
| 7,743,709 | B2 | 6/2010 | Kolnik et al. | |
| 7,934,454 | B2 | 5/2011 | Campo | F42B 12/40 102/502 |
| 7,954,409 | B1 | 6/2011 | Kolnik et al. | |
| 8,312,812 | B2 | 11/2012 | Kapeles | F42B 8/10 102/444 |
| 8,316,769 | B2 | 11/2012 | Wilson | F42B 8/02 102/439 |
| 8,479,656 | B2 * | 7/2013 | Ciesiun | F42B 6/10 102/502 |
| 8,689,696 | B1 | 4/2014 | Seeman | F42B 5/02 102/439 |
| 9,021,959 | B2 | 5/2015 | Hayes | F42B 10/00 102/439 |
| 2004/0216589 | A1 | 11/2004 | Amick | A01K 95/005 86/54 |
| 2006/0042456 | A1 | 3/2006 | Petersen | F42B 12/74 86/54 |
| 2006/0254453 | A1 | 11/2006 | Leal | F42B 12/40 102/513 |
| 2007/0234891 | A1 | 10/2007 | Puskas | F42B 12/745 86/54 |
| 2010/0101400 | A1 | 4/2010 | Campo | F42B 12/40 86/55 |
| 2010/0170321 | A1 | 7/2010 | Jones | B21D 53/14 72/405.02 |
| 2011/0048268 | A1 | 3/2011 | Ramsey | F41A 35/00 102/447 |
| 2011/0308419 | A1 | 12/2011 | Haremza | F42B 6/10 102/511 |
| 2012/0006220 | A1 | 1/2012 | Endicott, Jr. | F42B 12/40 102/513 |
| 2012/0101174 | A1 | 4/2012 | Mittag | B29C 44/352 521/79 |
| 2012/0137861 | A1 | 6/2012 | Jones | B21D 53/14 86/54 |
| 2013/0042783 | A1 | 2/2013 | Diller | F42B 7/04 102/513 |
| 2014/0326156 | A1 | 11/2014 | Flowers | F42B 12/745 102/439 |
| 2014/0364026 | A1 | 12/2014 | Rukavina | B32B 17/1077 442/59 |
| 2015/0107479 | A1 | 4/2015 | Amick | F42B 30/02 102/448 |
| 2015/0107481 | A1 | 4/2015 | Nygaard | F42B 12/74 102/514 |
| 2015/0276361 | A1 | 10/2015 | Seeman | F42B 5/02 86/18 |
| 2015/0308804 | A1 | 10/2015 | Seeman | F42B 12/74 102/430 |

* cited by examiner

REUSABLE POLYURETHANE PROJECTILE

CROSS REFERENCE TO RELATED APPLICATIONS

This application is a continuation of application Ser. No. 14/325,043, filed on Jul. 7, 2014 now U.S. Pat. No. 9,366,516 and issued on Jun. 14, 2016 which claims the benefit of Provisional Application Ser. No. 61/860,759 filed Jul. 31, 2013 the entire contents of which is hereby expressly incorporated by reference herein.

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC

Not Applicable

BACKGROUND OF THE INVENTION

Field of the Invention

This invention relates to improvements in a projectile. More particularly, the present reusable projectile is fabricated from a casting process that can be used in a bullet cartridge and inserted into a gun. The reusable projectile conforms to the rifling of the barrel. After the projectile hits a target the projectile can be reused with limited degradation.

Description of Related Art Including Information Disclosed Under 37 CFR 1.97 and 1.98

Most projectiles that are fired out of a gun, cannon or other firing armament that uses black powder or gun powder use a single use projectile. The projectile is deformed with the rifling of the barrel, and is further deformed when the projectile makes impact with a target. Either of both of these impacts deforms the projectile to a condition that the only way to re-use the projectile is to melt the projectile and reform the projectile. A number of other projectiles are made for non-lethal purposes, but these projectiles are custom designed to the firearm or operate outside of the firearm.

A number of patents and or publications have been made to address these issues. Exemplary examples of patents and or publication that try to address this/these problem(s) are identified and discussed below.

U.S. Pat. No. 6,295,933 issued on Oct. 2, 2001 to Bernard Dubocage discloses a Non-Lethal Projectile For Firearms. The projectile is a soft and elastic material that is formed into a ball, compressed pushed in a deformed condition into a cartridge. While the ball can be deformed and inserted into another cartridge, the ball is not in the shape of a bullet where the rifling of the barrel improves accuracy of the projectile. Because the projectile fit entirely within the cartridge, using the cartridge in a non-shotgun application would not allow the cartridge to automatically feed from a clip.

U.S. Pat. No. 7,278,358 issued Oct. 9, 2007 to Rick Huffman discloses a Non-Lethal Marking Bullet for Related Training Cartridges. The bullet has an outer casing that seals the inner marking material. Once the bullet hits a target the outer casing is compromised to allow the marking material to leave a visible indicator of the point of impact. The bullet operates in a shotgun and upon impact there are limited components that can be reused.

U.S. Pat. No. 7,063,021 issued on Jun. 20, 2006 and U.S. Pat. No. 7,237,490 issued on Jul. 3, 2007, both to Neil Keegstra et al., disclose an Expanded Volume Less Lethal Ball Type Projectile. The ball is deformed and pressed into a hull that guides the ball through the barrel of the firearm. The ball can then be collected and used in a future hull and base, but the ball requires an expendable hull to guide the ball through a shotgun barrel.

U.S. Pat. No. 8,312,812 issued on Nov. 20, 2012 to John A Kaples and U.S. Pat. No. 8,316,769 issued on Nov. 27, 2012 to Chris Wilson both disclose a training or non-lethal ammunition projectile. The reloadable training monition has a reusable shell base with a projectile that simulates the weight of an actual monition. The projectile is used for hand loading into a cannon for training purposes. While the projectile is reusable it is not used in in small arms guns and rifles where it is automatically loaded into the firearm for rapid shooting where the projectiles can be easily collected and reused.

What is needed is a reusable polyurethane projectile that approximates the size and shape of a bullet or other projectile. The proposed reusable polyurethane projectile provides a solution to this problem.

BRIEF SUMMARY OF THE INVENTION

It is an object of the reusable polyurethane projectile to be reusable. Because the projectile is reusable it can be pushed or inserted into a cartridge, fired, collected and reused with minimum degradation. The projectile follows the rifling of the firearm to improve the accuracy to a target. Upon impact the projectile will flatten and then rebound to the original shape. Standard re-loading mechanisms can be used to install the projectile back into a prepared cartridge. This reduces the cost to firing a cartridge to just the cost of the primer and the gunpowder.

It is an object of the reusable polyurethane projectile to be operable at high temperatures. The reusable projectile is fabricated from a casting process that increases the resistance of the polyurethane from melting when the hot gun gunpowder pushes the reusable projectile out of the barrel of the gun as well as the heat from frictional forces as the projectile moves through the barrel. Projectiles made from some molding operations can melt or leave residue within the barrel of the firearm that can increase over time and cause harm when an actual lethal projectile is fired.

It is another object of the reusable polyurethane projectile to include a metallic jacket or metallic insert. When the insert is cast in the center of the polyurethane, the polyurethane can be reused because the polyurethane conforms to the barrel and then rebounds. When the polyurethane is cast into a jacket, the polyurethane can absorb an impact and mushroom to cushion when the projectile makes contact with a hard surface.

It is another object of the reusable polyurethane projectile to be less lethal. Because the projectile can deform or flatten and then return to the original shape the projectile is less lethal than a hard bullet or other metallic projectile. The amount of gunpowder can be adjusted to reduce the velocity and impact force when the projectile reaches a target. The size of the projectile is easy to fabricate based upon the bore of the firearm and the desired length to diameter ratio.

It is still another object of the reusable polyurethane projectile to perform like a bullet or projectile. This performance has multiple benefits. Because the projectile is essentially the same size and shape of a bullet it can be fed through a normal bullet clip into the breach of a gun, fired and ejected. Another benefit of the projectile having the same size and shape of a bullet is that the projectile will conform to the rifling of the barrel of the firearm to spin the projectile and provide equivalent accuracy to a metallic bullet.

Various objects, features, aspects, and advantages of the present invention will become more apparent from the following detailed description of preferred embodiments of the invention, along with the accompanying drawings in which like numerals represent like components.

BRIEF DESCRIPTION OF THE SEVERAL VIEWS OF THE DRAWING(S)

DETAILED DESCRIPTION OF THE INVENTION

Figure 1:
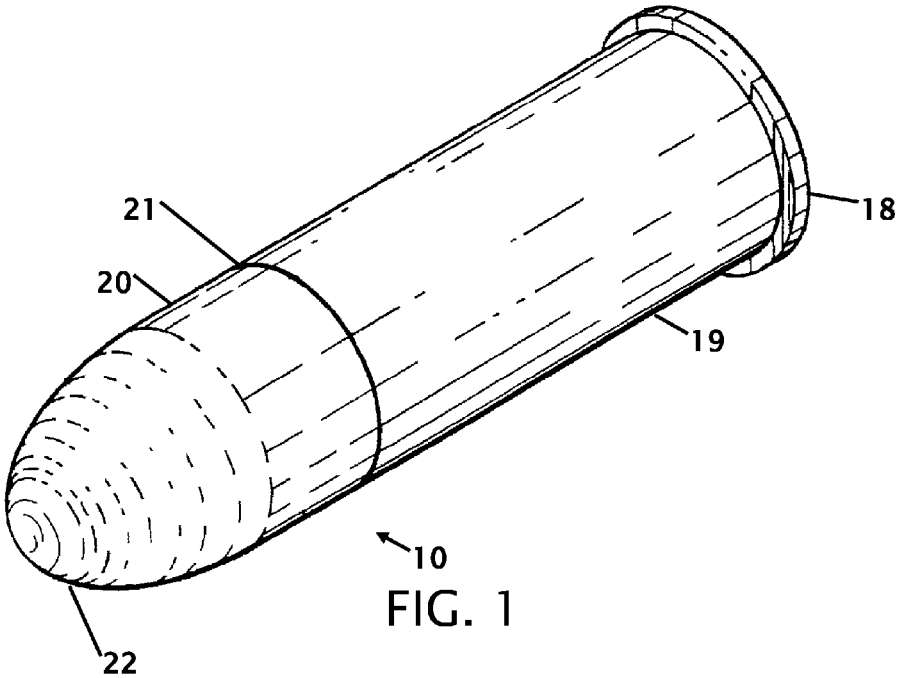
FIG. 1 shows a reusable projectile in a cartridge.

FIG. 1 shows a reusable projectile 10 in a cartridge. Polyurethane is a polymer resin widely used in molding because of its many material qualities. Its hardness can range from 10 shore A to 80 shore D, so polyurethane can simulate many production materials, from hard plastics, to soft rubbers. Urethanes are known as room temperature volcanizing materials because they can be created at room temperature. The mainstay of RTV molding is the ability to closely match parts production material characteristics. In the preferred embodiment the polyurethane is shore A 40 to 99, or shore D 10 to 50, but could be fabricated beyond the provided values depending upon the desired performance of the projectile. Modern urethanes can also withstand heat up to 220 F, making them functional in a wide range of environments and especially in the preferred embodiment where the projectile is briefly subjected to high temperatures of expanding gun powder and frictional forces as the projectile moves through the barrel.

The polyurethane can be blended with different metals such as, but not limited to tungsten powder, copper powder or other materials that increase the weight of the projectile and still provides the impact cushion that allows the reusable projectile 10 to be reused.

This figure shows the reusable projectile 10 with a cylindrical mid-section 20 having a first end that is captured in a shell casing 19. The second end is shown as an elliptical taper 22. While an elliptical taper is shown, the second end could be configured as a round, flat, hollow point or other shape depending upon the desired flight and impact characteristics. The shell is essentially a common or standard shell casing, but can be a custom shape to fit a particular firearm or armament. The shell is cylindrical is shape, but can have a step such as a .30-6 or other similar shell. A typical shell has a rim 18 for either a rim fire or can be loaded with a primer in the central bottom of the rim 18.

Figure 2:
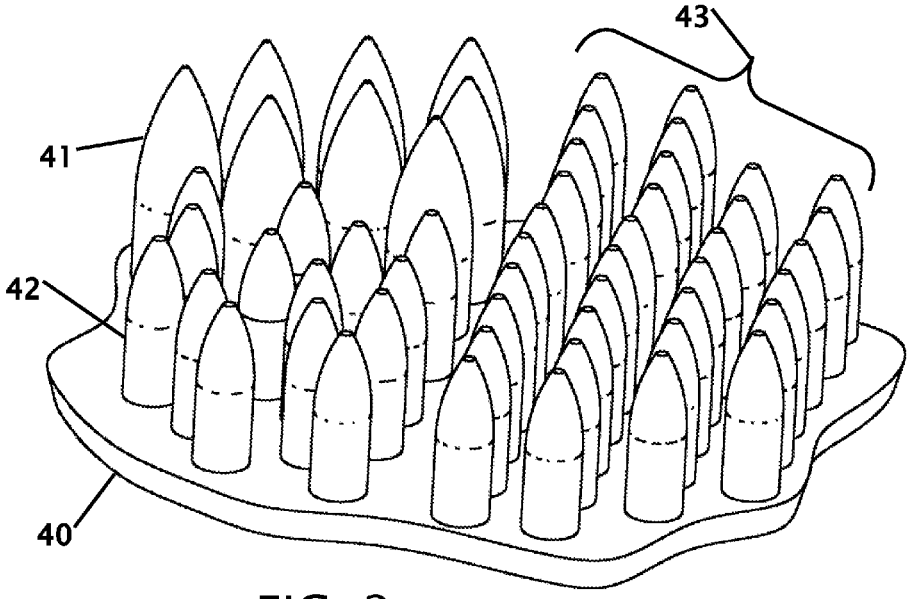
FIG. 2 shows a matrix of reusable projectiles after casting.

FIG. 2 shows a matrix of reusable projectiles after casting. In the preferred embodiment the projectiles are cast, poured or molded in a collective group as shown after the collective group is removed from a mold. The mold shows two different size and or shapes of projectiles 41 and 42. The projectiles can be formed in an oriented matrix 43 of rows and columns, circular, spiral or randomly placed to provide the best fabrication density. or can be just a single projectile. In this figure shows the multiple projectiles after mold has been inverted and the projectiles have been removed from the mold. The projectiles are created by pouring liquid polyurethane into a mold and the polyurethane fills the projectile voids to create the projectiles. Excess polyurethane is poured into the mold and the excess polyurethane creates a sprue, runner or gate 40.

Figure 3:
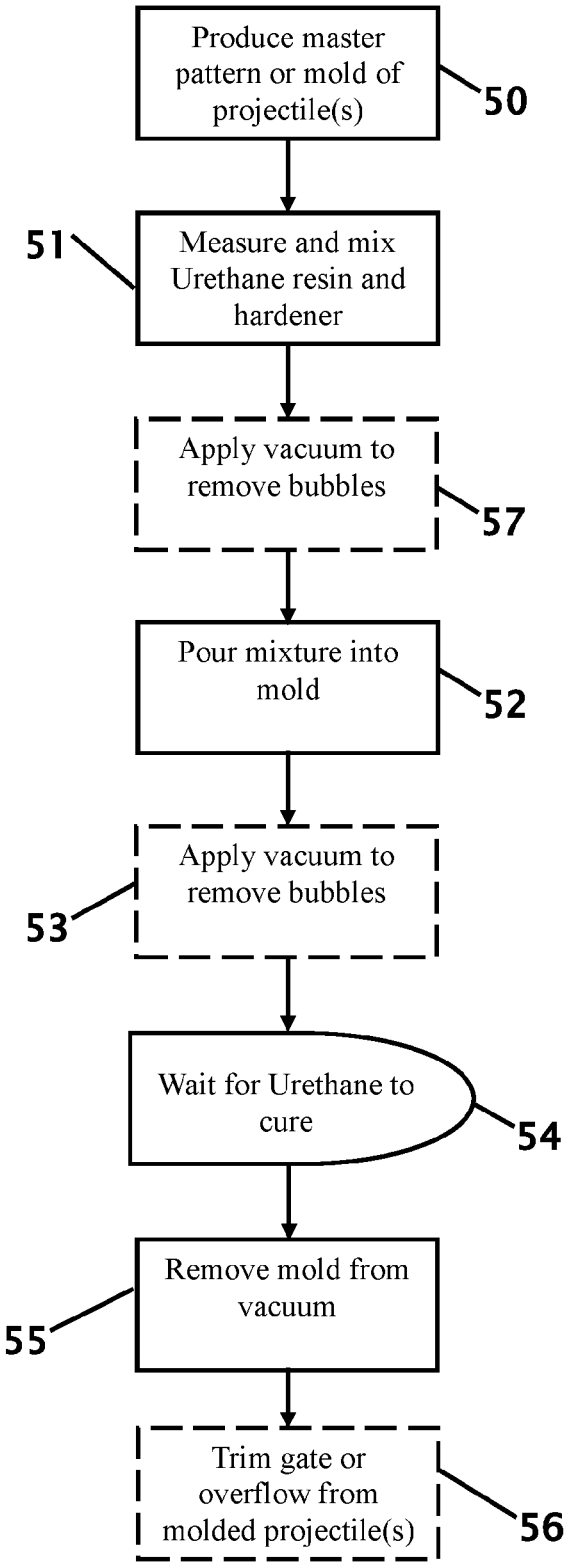
FIG. 3 shows the process of manufacturing the reusable projectiles.
Figure 4:
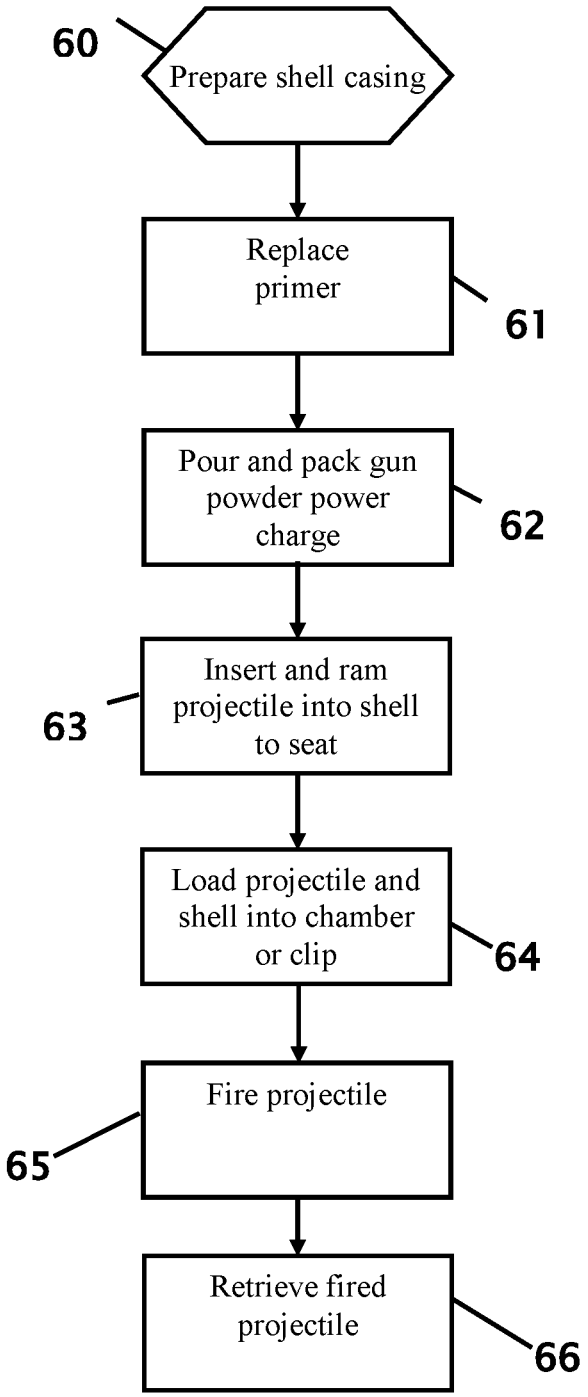
FIG. 4 shows the process of using the reusable projectiles.

FIG. 3 shows the process of manufacturing the reusable projectiles. Before creating a mold the desired profile and shape of the projectile(s) is determined and a master pattern or mold is created. Depending upon the desired casting, molding or pouring process a master pattern, or mold of the projectile is created 50. Producing cast urethane parts starts with the creation of a master pattern. SLA rapid prototypes are typically used for the patterns, but SLS and Polyjet prototypes work as well. In one embodiment to make the mold, silicone rubber is poured around the pattern. Once the silicone has set the pattern is removed, leaving a negative image which polyurethane can then be cast into. Because silicone molds are flexible, they tend to be more forgiving, and slides are usually not required for minor undercuts.

In another contemplated embodiment, insert or over molding is created with silicone molds. To make over molded parts two patterns are made, one with the over mold, and one without. Then the two molds are made from the masters, and the urethane parts are cast. First, the base part is cast using the mold without the over mold. Then, the part is moved into the second mold, so that the second casting can be poured over it. The Urethane Casting process is capable of reproducing small details. Due to the flexibility of the molds, draft angles and undercuts are not as critical as it is in other molding processes.

The chemical formula for the compound polyurethane is ROC(O)N(H)R. The molecular formula for urethane, also known as ethyl carbamate, is $C_3H_7NO_2$. Polyurethane is a polymer which is made up of several organic units which are joined by urethane or carbamate links. Polyurethane bridges the gap between rubber and plastics by combining rubber's characteristics with the cut, tear, and abrasion resistance of plastics.

Polyurethane is a mixture of urethane resin and hardener. The accuracy of the mixture is important to the success of the resulting projectile. The urethane resin and the hardener are thoroughly mixed 51 and the mixture is poured, injected or otherwise introduced into the mold 52. A vacuum can be applied to the mixture 57 to remove bubbles from the mixture before the mixture is deposited into the cavity. When the vacuum is applied to the mixture prior to depositing the mixture into the cavities, step 53 to remove bubbles is typically not applied during the process. The master pattern is attached to a gate assembly and suspended into either a frame or a box or simply poured into the pattern or mold. In the preferred embodiment the mold can be placed in a vacuum 53 chamber to allow air bubbles to float to the surface and improve the homogeneous nature of the resulting projectile. Once the urethane has hardened or cured 54, it is removed and the process can be repeated using the same mold to cast additional parts.

In the embodiment shown in FIG. 2 the mold in inverted and the polyurethane projectile array is pulled from the mold 55. Individual or collective projectiles are cut, trimmed, or otherwise removed 56 from the surrounding gate, sprue or runner 40 to result in individual projectiles. One or multiple dispensing heads can dispense material directly into the cavities and fill each cavity with the desired amount of material thereby eliminating any sprue or runner and thereby eliminating any need to trim the projectiles.

Figure 5:
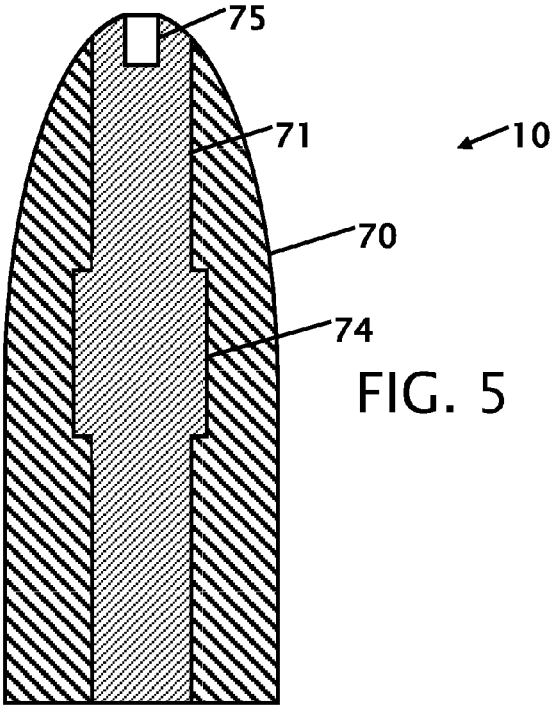
FIG. 5 shows the polyurethane cast around a metal insert.
Figure 6:
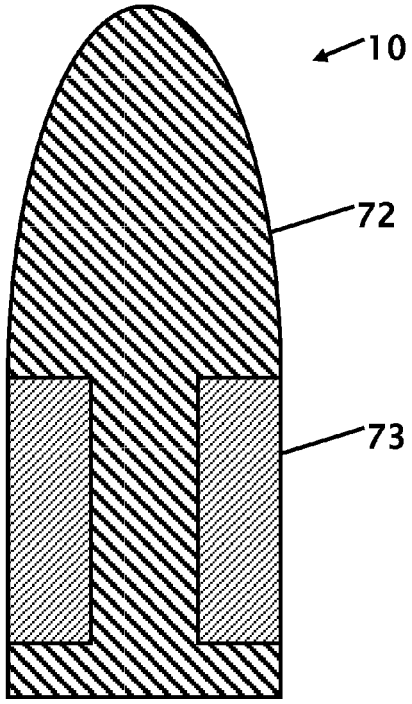
FIG. 6 shows the polyurethane cast within a metal insert.

FIG. 5 shows the projectile 10 with polyurethane 70 cast around a metal insert 71 and FIG. 6 shows the projectile 10 with polyurethane 72 cast within a metal insert or ring 73. These two versions show the reusable polyurethane projectile to include a metallic jacket or metallic insert. When the insert 71 is cast in the center of the polyurethane 70, the polyurethane can be reused because the polyurethane conforms to the barrel and then rebounds. The insert 71 can have one or more rings or edges 74 to retain the insert within the polyurethane 72. The metallic insert 71 may further have a recess 75 for locating the metallic insert prior to casting the polyurethane. If the metallic insert 71 is not damaged, the projectile can be reused.

When the polyurethane 72 is cast into a jacket, the polyurethane can absorb an impact and mushroom to cushion when the projectile makes contact with a hard surface. The metal insert or jacket can be fabricated from a variety of materials, including but not limited to lead, steel, brass, copper, aluminum, stainless steel or other materials. While a particular size and shape of insert or jacket is shown, it should be understood by one skilled in the art that other sizes and shapes of inserts or jackets are contemplated.

Figure 7:
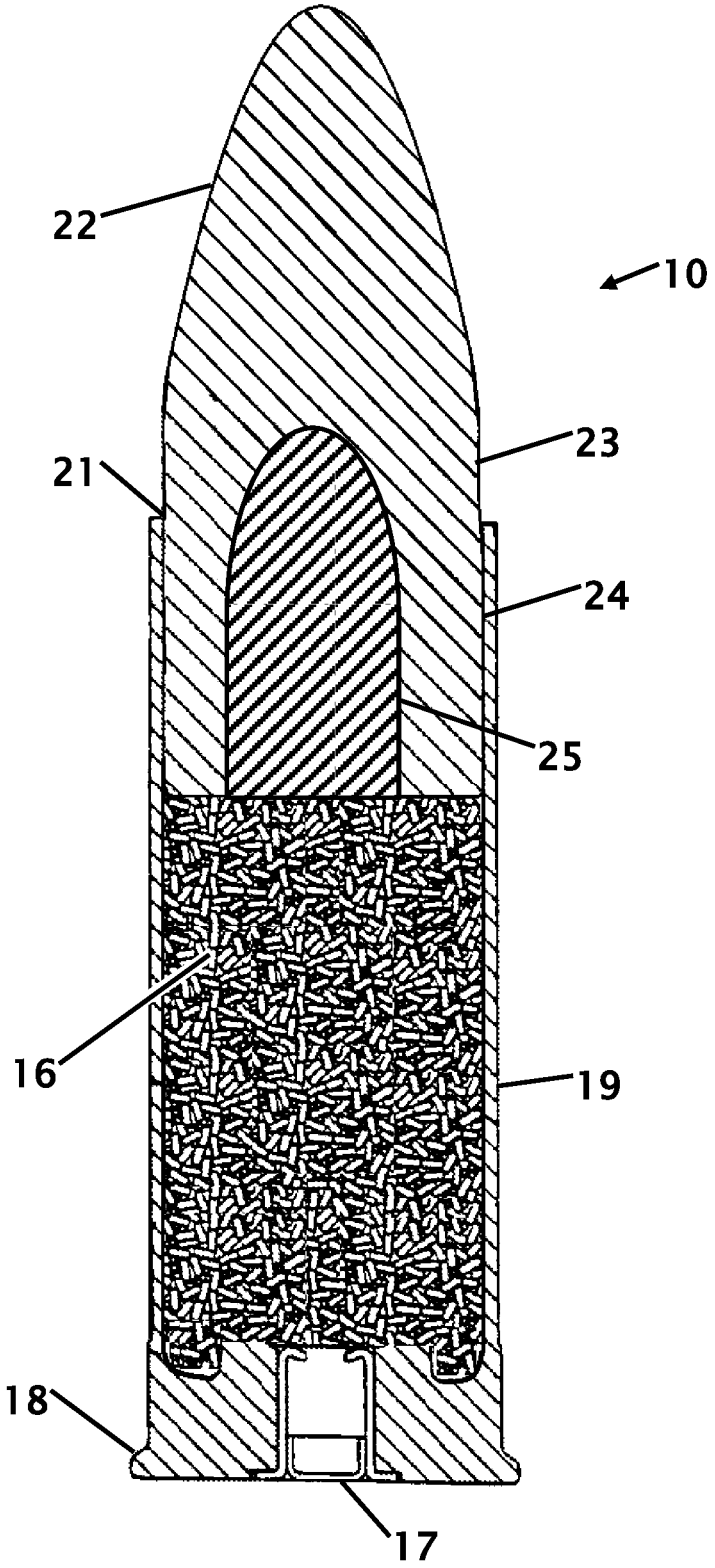
FIG. 7 shows a cross-sectional view of the reusable projectile.

FIG. 7 shows the process of using the reusable projectiles, and FIG. 5 shows a cross-sectional view of the reusable projectile. At the beginning of the process the shell or brass is prepared 60. In an optimal situation the brass casing 19 is tumbled, wiped clean and inspected for splits, cracks, or bulging. Any defective cases should be deformed and thrown away to prevent confusion between a good casing and an uninspected or bad case. The brass should be lightly lubricated. A sizing die is used to ensure that the diameter is correct. The length and width should also be measured to ensure optimal operation because cases will always stretch, becoming longer after several firings, you must check the length and trim to size for proper chambering and safety. The outer edge 21 should be de-burred and often bevels the case for easier seating of the bullet. It is also contemplated that the polyurethane projectile can have an insert 25 or be insert cast to achieve a desirable weight or mass.

The case is primed 61 by inserting a primer 17 into bottom of case. A good way is to use a hand held priming tool to insert primers into the case. This provides a better feel for the primer being inserted. The other method is to use the reloading press and a priming tool attachment for seating primers.

The powder charge 16 is poured or packed into the case 19. Because the projectile is polyurethane the powder charge 63 can be adjusted to the desirable projectile velocity. A user can consult a reputable reloading manual and look up your load and learn which powder and what charge amount to fill the shell 19. The shell should again be inspected to ensure even charges in each case 19.

The polyurethane projectile is the seated in the case 19 using a seater die. Because the projectile is polyurethane the projectile 10 can be manually pushed into the case 19 such that the cylindrical body 23 of the polyurethane projectile is essentially concentric with the inside diameter 24 of the case 19. When using a seater die, the case 19 is placed into the shell holder and the handle of the press in lowered, thereby, running the case 19 to the top of the press stroke. When the polyurethane projectile is properly seated the projectile can be used in a firearm or armament.

After the polyurethane projectile is fired 65 the polyurethane projectile will follow the rifling of a barrel and with approximate the accuracy of a non-polyurethane projectile. The polyurethane projectile can be retrieved for use again. This operation can take place as many times as the projectile retains its initial size and shape. There can be some degradation with the polyurethane projectile makes contact with abrasive surface.

Thus, specific embodiments of a reusable polyurethane projectile have been disclosed. It should be apparent, however, to those skilled in the art that many more modifications besides those described are possible without departing from the inventive concepts herein. The inventive subject matter, therefore, is not to be restricted except in the spirit of the appended claims.

The invention claimed is:

1. A method of making and using a reusable polyurethane projectile comprising:

creating a mold for a projectile;

measuring and mixing a urethane resin and a hardener to create a polyurethane mixture;

said polyurethane mixture is blended with tungsten powder or copper powder;

introducing said polyurethane mixture into said mold;

applying a vacuum to a curing projectile;

allowing said polyurethane mixture to cure;

removing said cured polyurethane mixture from said mold;

trimming at least one projectile from said cured polyurethane to create a polyurethane projectile;

preparing a shell to accept said polyurethane projectile;

inserting said polyurethane projectile into said prepared shell;

using said polyurethane projectile in said prepared shell, and retrieving said polyurethane projectile for reuse in a prepared shell.

2. The method of making and using a reusable polyurethane projectile according to claim 1 wherein said polyurethane projectile has a hardness of between shore A 40 to 99, or shore D 10 to 50.

3. The method of making and using a reusable polyurethane projectile according to claim 1 wherein said introducing is with a casting, pouring or injecting.

4. The method of making and using a reusable polyurethane projectile according to claim 1 wherein said polyurethane is $C_3H_7NO_2$.

5. The method of making and using a reusable polyurethane projectile according to claim 1 wherein said applying of said vacuum is applied to said mixture prior to said curing.

6. The method of making and using a reusable polyurethane projectile according to claim 1 wherein said projectile is not permanently deformed for rifling of a firearm.

7. The method of making and using a reusable polyurethane projectile according to claim 1 wherein said projectile further includes a metal insert placed at least partially within said projectile or a metal jacket placed at least partially around said polyurethane.

8. The method of making and using a reusable polyurethane projectile according to claim 7, wherein said insert or jacket alters kinetic inertial of said projectile.

9. The method of making and using a reusable polyurethane projectile according to claim 7 wherein said metal insert or said metal jacket is selected from a group consisting of lead, tin, iron, steel, brass, copper, aluminum and stainless steel.

10. A method of making and using a reusable polyurethane projectile comprising:

creating a mold for a projectile;

measuring and mixing a urethane resin and a hardener to create a polyurethane mixture;

introducing said polyurethane mixture into said mold based upon the volume of at least one cavity of said mold;

placing a metal insert placed at least partially within said projectile or a metal jacket placed at least partially around said polyurethane;

said metal insert or said metal jacket is selected from a group consisting of lead, tin, iron, steel, brass, copper, aluminum and stainless steel;

applying a vacuum to a curing projectile;

allowing said polyurethane mixture to cure;

removing said cured polyurethane mixture from said mold;

preparing a shell to accept said polyurethane projectile;

inserting said polyurethane projectile into said prepared shell;

using said polyurethane projectile in said prepared shell, and retrieving said polyurethane projectile for reuse in a prepared shell.

11. The method of making and using a reusable polyurethane projectile according to claim 10 wherein said polyurethane projectile has a hardness of between shore A 40 to 99, or shore D 10 to 50.

12. The method of making and using a reusable polyurethane projectile according to claim 10 wherein said introducing is with a casting, pouring or injecting.

13. The method of making and using a reusable polyurethane projectile according to claim 10 wherein said polyurethane is $C_3H_7NO_2$.

14. The method of making and using a reusable polyurethane projectile according to claim 10 wherein said applying of said vacuum is applied to said mixture prior to said curing.

15. The method of making and using a reusable polyurethane projectile according to claim 10 wherein said polyurethane mixture is blended with tungsten powder or copper powder.

16. The method of making and using a reusable polyurethane projectile according to claim 10 wherein said projectile is not permanently deformed for rifling of a firearm.

17. The method of making and using a reusable polyurethane projectile according to claim 10 wherein said insert or jacket alters kinetic inertial of said projectile.

* * * * *